US009688460B1

(12) United States Patent
Yiu et al.

(10) Patent No.: US 9,688,460 B1
(45) Date of Patent: Jun. 27, 2017

(54) TOY CANDY DISPENSER

(71) Applicant: Sweet N Fun Ltd., TST East (HK)

(72) Inventors: Tak Kin Yiu, TST East (HK); Maggie Yin Ting Luk, TST East (HK); Candona Yuet Sum Fung, TST East (HK)

(73) Assignee: Sweet N Fun Ltd., Hong Kong (HK)

( * ) Notice: Subject to any disclaimer, the term of this patent is extended or adjusted under 35 U.S.C. 154(b) by 0 days.

(21) Appl. No.: 15/191,245

(22) Filed: Jun. 23, 2016

(51) Int. Cl.
*B65D 83/04* (2006.01)
*B65D 47/28* (2006.01)
*B65D 85/60* (2006.01)

(52) U.S. Cl.
CPC ..... *B65D 83/0481* (2013.01); *B65D 47/286* (2013.01); *B65D 85/60* (2013.01); *B65D 2583/0463* (2013.01); *B65D 2583/0481* (2013.01)

(58) Field of Classification Search
CPC ..... B65D 83/0481; B65D 83/0409; B65D 2583/0481; B65D 83/0454; B65D 47/286; B65D 85/60
USPC ..... 221/236, 268, 276
See application file for complete search history.

(56) References Cited

U.S. PATENT DOCUMENTS 4,354,619 A * 10/1982 Wippermann ..... B65D 83/0409 206/540
5,178,298 A * 1/1993 Allina ..... B65D 83/0418 206/457
7,988,016 B2 * 8/2011 Klein ..... B65D 50/062 221/1
9,126,742 B2 * 9/2015 Elliott ..... B65D 83/0409
2007/0114239 A1 * 5/2007 Smith ..... B65D 83/0409 221/263

* cited by examiner

*Primary Examiner* — Timothy Waggoner
(74) *Attorney, Agent, or Firm* — Raymond Sun

(57) ABSTRACT

A dispensing apparatus having a lower housing having an opening, and a reservoir piece seated inside the lower housing and having a containing section that holds at least one item to be dispensed, the containing section having an enclosing wall, a base and an opening provided in the enclosing wall that communicates with the interior of the containing section. A biasing element is positioned between the base of the reservoir piece and the lower housing, with the biasing element normally biasing the reservoir piece to a non-dispensing position where the openings are not aligned. The apparatus also has an upper housing, and the upper housing and lower housing can be squeezed together to cause the reservoir piece to move downwardly against the normal bias of the biasing element, so as to align the openings to arrive at a dispensing position.

7 Claims, 7 Drawing Sheets

12
65
30
60
62
64
58
28
70
42
46
32
48
10
38
20

36
48
40
18
14

TOY CANDY DISPENSER

BACKGROUND OF THE INVENTION

1. Field of the Invention

The present invention relates to toys, and more particularly to a toy which dispenses candy.

2. Description of the Prior Art

Candies and toys have always gone together. Children enjoy eating candy as much as they enjoy playing with toys. Therefore, candy is often provided in fanciful or interesting containers that would appeal to a child.

One type of candy container comes in a fanciful shape or design, and can itself be a toy. Unfortunately, the child has to open the container to access the candy, which can be inconvenient and often results in spillage if the child is not careful.

Another type of candy container can be toys or candy containers that dispense candy. A simple and longstanding example of such a toy is a gumball machine. Gumball machines are often provided with lights and sounds that are generated when a candy is being dispensed. Children enjoy the visual stimulation and novelty provided by these candy dispensers. One drawback associated with gumball machines is that they can be large or bulky.

In addition, it is often desirable to provide candy containers in a size that allows a user or child to place it into his or her pocket so that a child can have a toy that also functions as a candy container. The large or bulky gumball machines would be unwieldy for such a purpose, and the containers that do not automatically dispense candy can be inconvenient to use.

Thus, there remains a need for a container for storing candy, which is small enough to allow it to fit inside a pocket, yet provides convenient dispensing of the candy stored therein.

SUMMARY OF THE DISCLOSURE

In order to accomplish the objects of the present invention, there is provided a dispensing apparatus having a lower housing having an opening, and a reservoir piece seated inside the lower housing and having a containing section that holds at least one item to be dispensed, the containing section having an enclosing wall, a base and an opening provided in the enclosing wall that communicates with the interior of the containing section. A biasing element is positioned between the base of the reservoir piece and the lower housing, with the biasing element normally biasing the reservoir piece to a non-dispensing position where the openings are not aligned. The apparatus also has an upper housing, and the upper housing and lower housing can be squeezed together to cause the reservoir piece to move downwardly against the normal bias of the biasing element, so as to align the openings to arrive at a dispensing position.

DETAILED DESCRIPTION OF THE PREFERRED EMBODIMENTS

Figure 1:
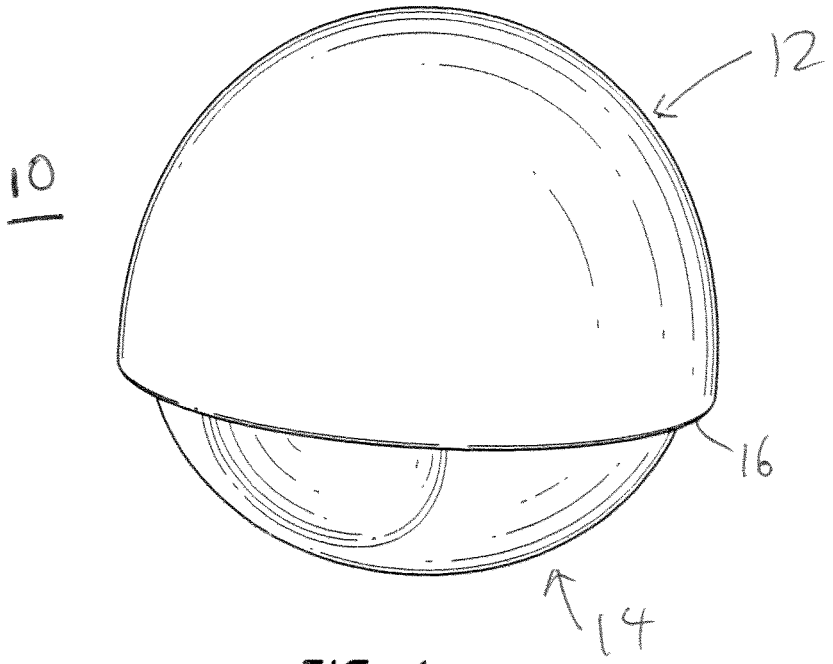
FIG. 1 is an upper perspective view of a candy dispenser according to one embodiment of the present invention.
Figure 2:
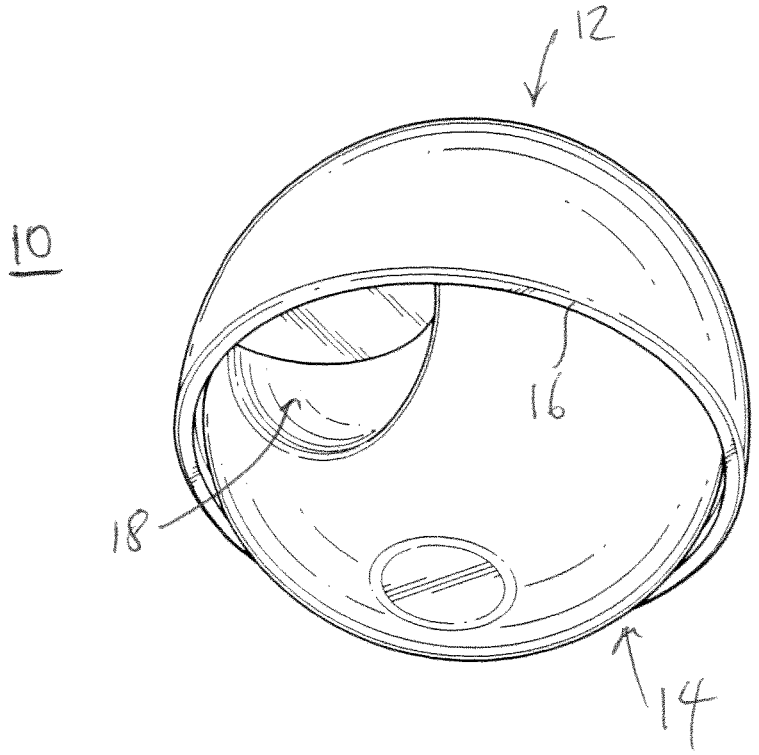
FIG. 2 is a lower perspective view of the candy dispenser of FIG. 1.
Figure 3A:
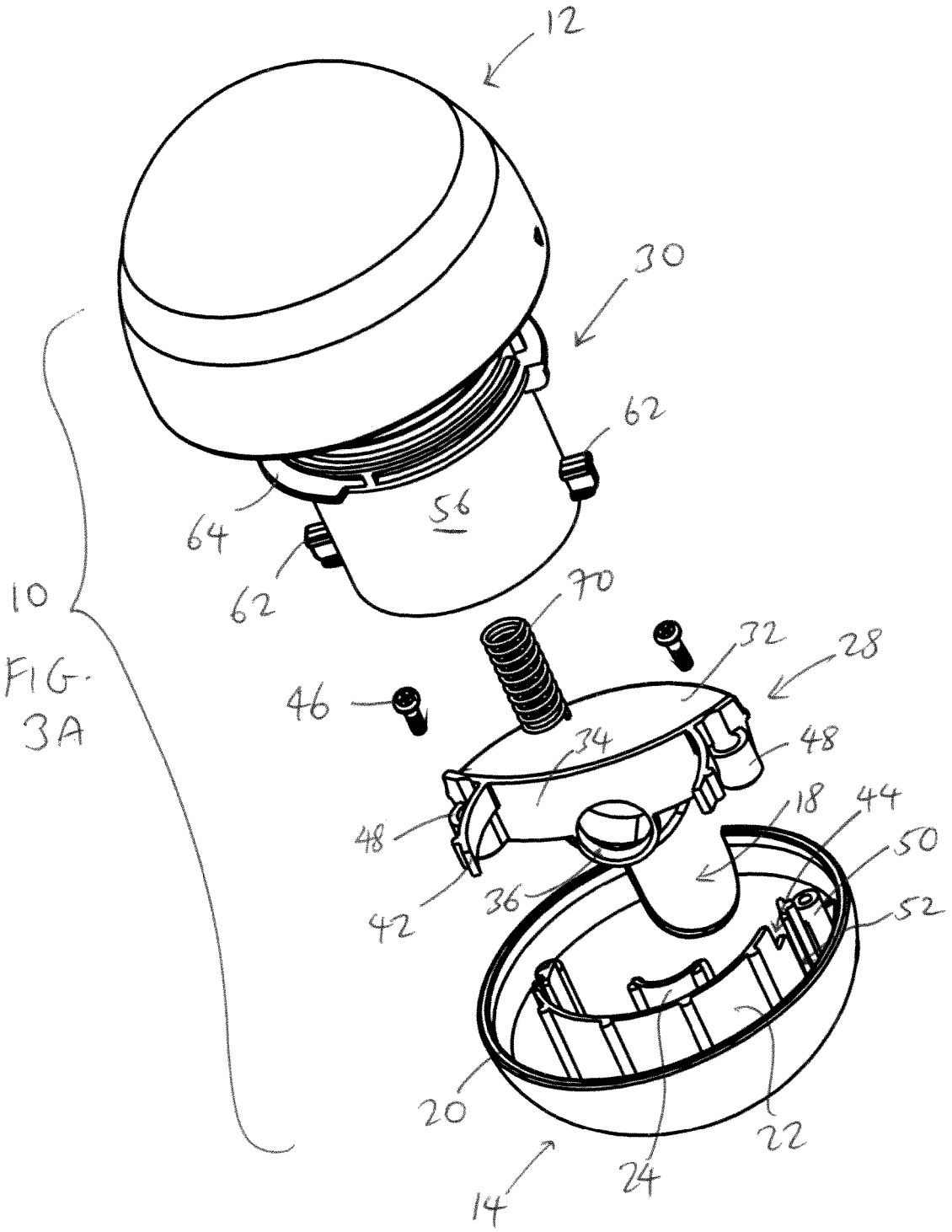
FIG. 3A is an exploded upper rear perspective view of the candy dispenser of FIG. 1.
Figure 3B:
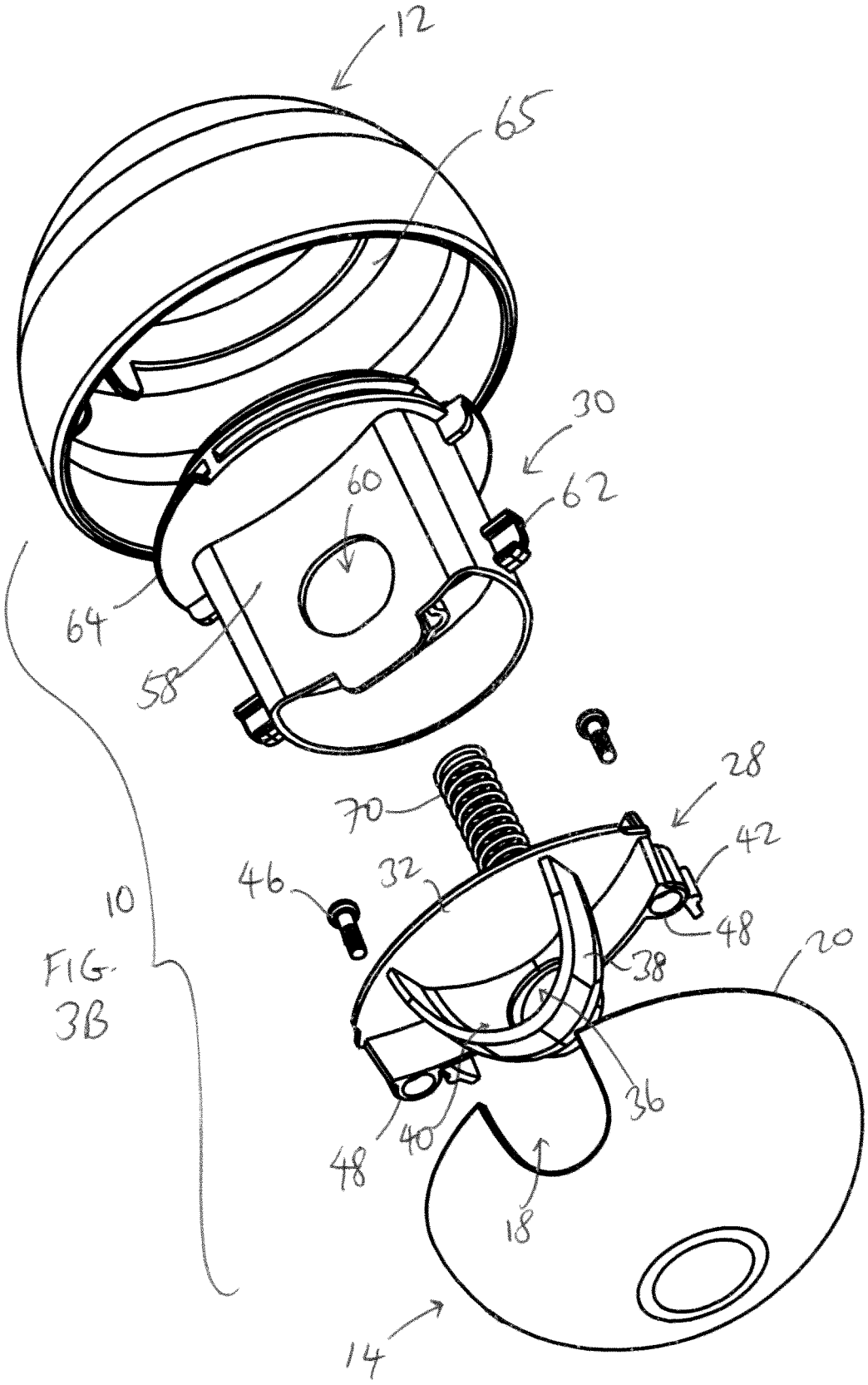
FIG. 3B is an exploded lower front perspective view of the candy dispenser of FIG. 1.
Figure 4:
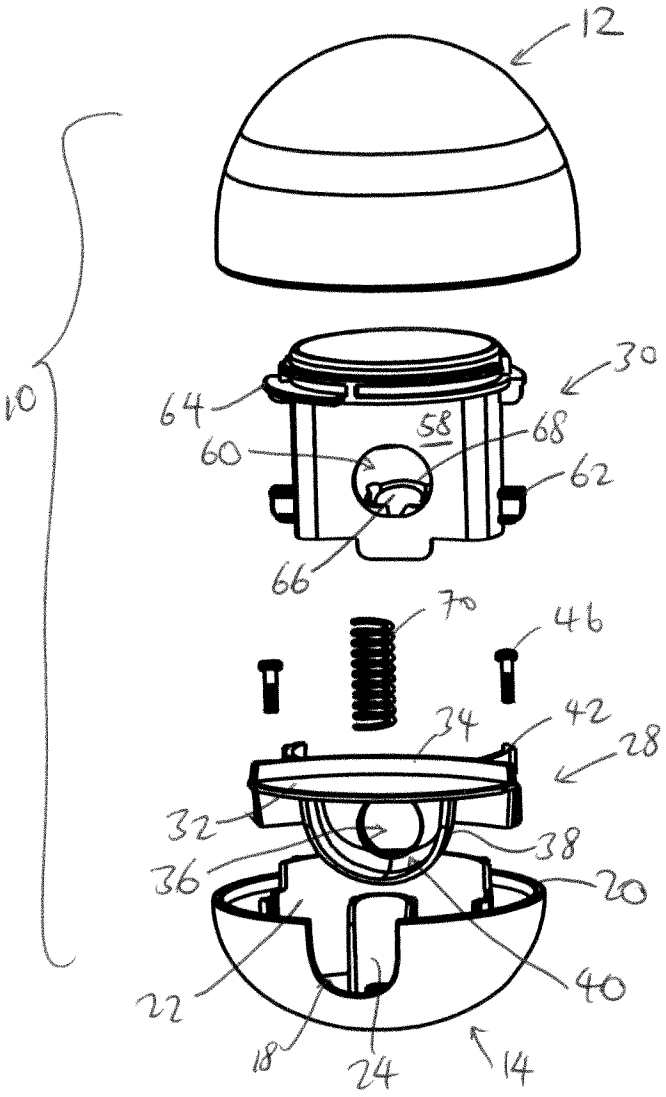
FIG. 4 is an exploded front perspective view of the candy dispenser of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a candy dispenser that can be sized and shaped to fit inside a pocket, and can automatically dispense the candy contained therein by simply squeezing the candy dispenser. Even though it has been described in connection with candy, the present invention can be used for almost any item.

Referring to FIGS. 1-7, the candy dispenser 10 has an upper housing 12 and a lower housing 14 that together define an interior space. The upper housing 12 and lower housing 14 can both have a hemispherical shape, and the upper housing 12 can be sized to be larger than the lower housing 14 such that the annular edge 16 of the upper housing 12 can overhang the periphery of the lower housing 14. The lower housing 14 has a generally U-shaped opening 18 cut from its upper edge 20. A curved support wall 22 extends from the bottom of the interior of the lower housing 14, and a curved guide wall 24 also extends from the bottom of the interior of the lower housing 14, but at a location between the U-shaped opening 18 and the support wall 22.

The dispenser 10 also includes a platform 28 and a reservoir piece 30. The platform 28 has a horizontal top wall 32 that is shaped with two curved edges, and a rear curved vertical wall 34 is provided at the rear edge of the top wall 32. The rear wall 34 extends from slightly above the top wall 32 to below the top wall 32, and has an opening 36 at the bottom of the top wall 32 near the center. The opening 36 is surrounded and partially defined by a U-shaped ringed support 38 that defines a generally U-shaped collection area 40 at the front facing side. The platform 28 also includes two rearwardly-extending curved wings 42 that are sized, shaped and adapted to be seated on (and aligned with) a cut-out region 44 at the opposite ends of the support wall 22. The platform 28 is seated on the lower housing 14 by resting the front peripheral edge of the top wall 32 on top of the upper edge 20 of the lower housing 14 adjacent the U-shaped opening 18, and resting the wings 42 on the support wall 22 at the cut-out regions 44. The platform 28 can then be secured to the lower housing 14 by screws 46 extended through screw posts 48 and 50 provided on the platform 28 and the lower housing 14, respectively. Two vertical slots 52 are defined at the opposite ends of the support wall adjacent the location of each cut-out region 44.

The reservoir piece 30 functions to house the candy or other item to be dispensed. The reservoir piece 30 has a generally cylindrical storage section 54 (see FIG. 7) defined by a rear convex wall section 56 and a front concave wall section 58 that extends inwardly. The front section 58 has an opening 60 that is sized and shaped to be aligned with the opening 36 of the platform 28. Two tabs 62 extend on opposite sides of the rear section 56, with each tab 62 adapted to slide up and down in a separate slot 52. The upper part of the cylindrical storage section has ledge portions 64 that are adapted to be engaged with corresponding retaining ledges 65 that are provided in the upper portion of the upper housing 12. The bottom wall 66 of the reservoir piece 30 has a curved slit 68.

A biasing element (e.g., spring 70) is provided between the bottom wall 66 and the bottom of the lower housing 14.

The dispenser 10 is constructed in the following manner. The reservoir piece 30 is first seated into the lower housing 14 in a manner where the tabs 62 are fitted into the slots 52, and the curved guide wall 24 extends through the curved slit 68. The spring 70 is positioned between the bottom wall 66 and the bottom of the lower housing 14. The curved support wall 22 provides rear support for the rear section 56 of the reservoir piece 30. The platform 28 is then slid in from the front so that the wings 42 are fitted into the cut-out regions 44 and cover the slots 52, thereby defining a stop member for the upper limit of motion for the tabs 62 inside the slots 52. The screws 46 are then extended through screw posts 48 and 50 provided on the platform 28 and the lower housing 14, respectively, to secure the platform 28 to the lower housing 14 with the reservoir piece 30 retained inside the lower housing 14 in a manner where it can move up and down as guided by the tabs 62 inside the slots 52. Note that the opening 36 on the platform 28 is always aligned with the U-shaped opening 18 on the lower housing 14, but the opening 60 of the reservoir piece 30 is not always aligned with the opening 36. The spring 70 normally biases the container piece 30 upwardly. At this point, the interior of the cylindrical storage section 54 can be filled with candy. Preferably, the candy or item should be sized and shaped (e.g., rounded or spherical or almost any shape that allows for the candy to pass through the openings 36 and 60) so that the candy can roll along the travel paths (described below) for the dispenser 10. The upper housing 12 can then be secured to the top of the cylindrical storage section 54 by twisting or turning it about the ledge portions 64 and 65 to secure the ledge portions 64 to the corresponding retaining ledges (not shown) that are provided in the upper portion of the upper housing 12.

Figure 5:
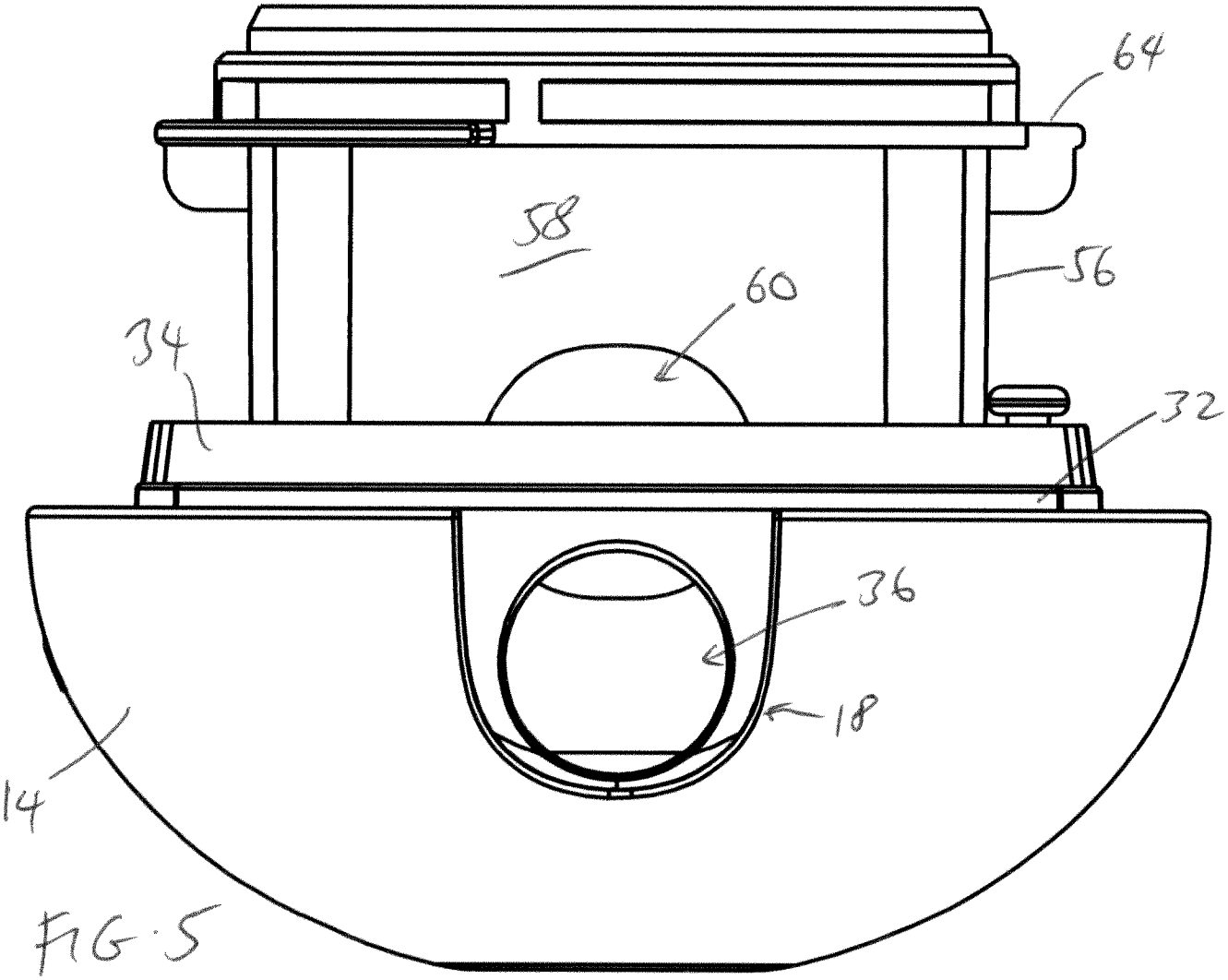
FIG. 5 is a front view showing the candy dispenser of FIG. 1 without the upper housing when in the non-dispensing position.
Figure 6:
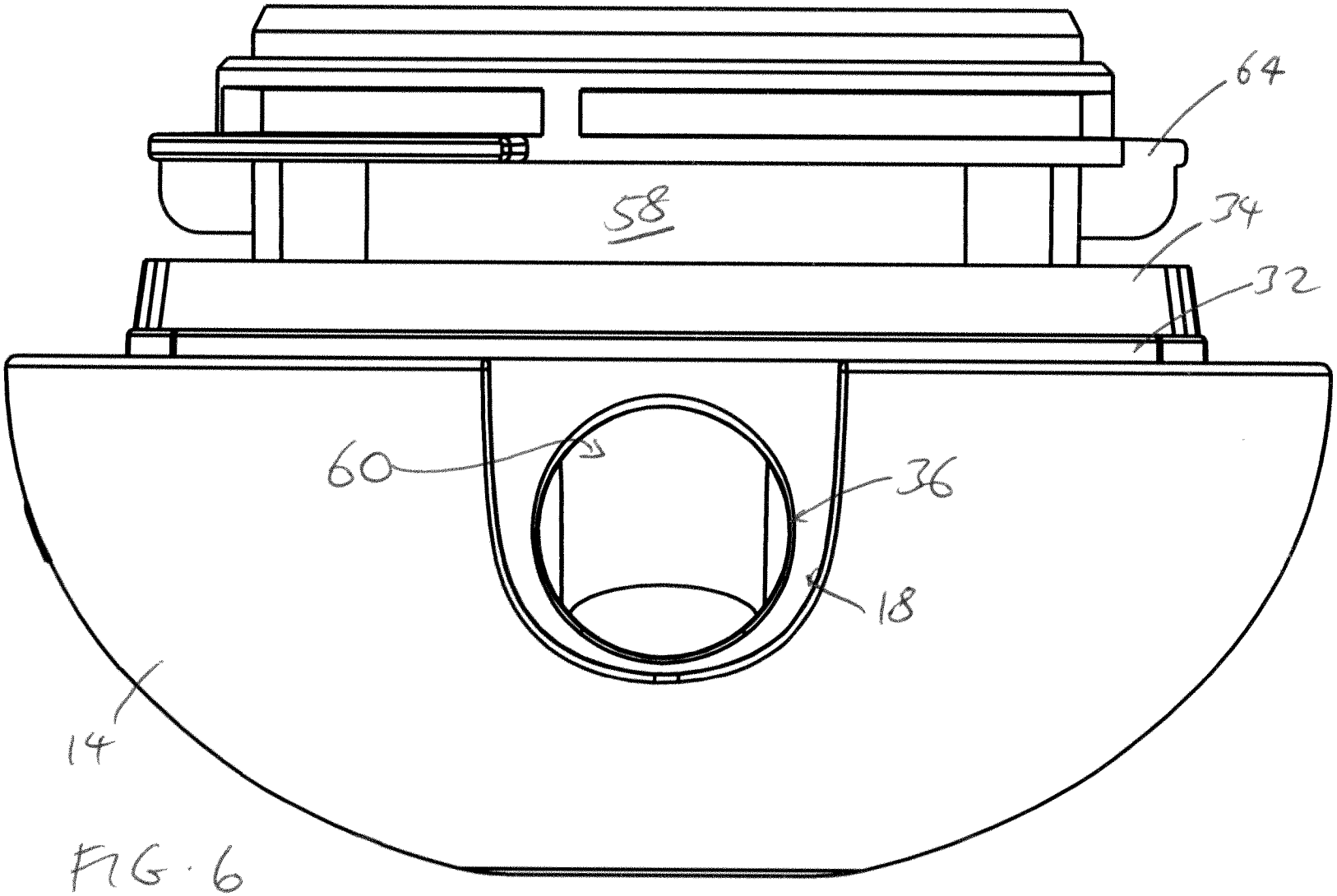
FIG. 6 is a front view showing the candy dispenser of FIG. 1 without the upper housing when in the dispensing position.
Figure 7:
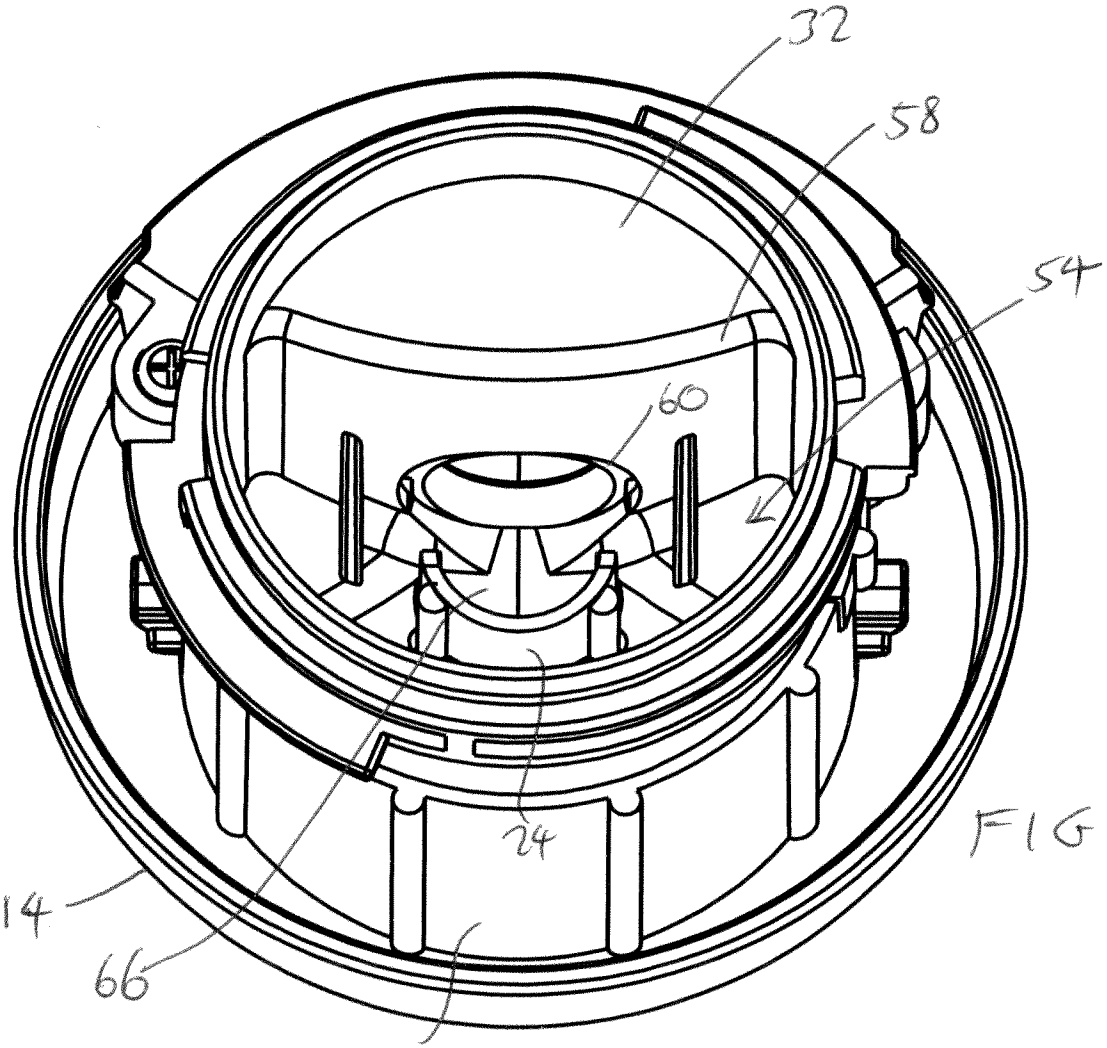
FIG. 7 is an upper perspective view showing the candy dispenser of FIG. 1 without the upper housing when in the dispensing position.

In the normal non-dispensing position as shown in FIG. 5, the spring 70 normally biases the reservoir piece 30 upwardly so that the opening 60 is mis-aligned with the opening 36. As a result, the contents inside the cylindrical storage section 54 cannot exit the opening 60.

When the user wishes to dispense an item (e.g., a candy) from the interior of the cylindrical storage section 54, the user grips the dispenser 10 with one hand and presses or squeezes the upper housing 12 and lower housing 14 together. This force overcomes the natural bias of the spring 70 and causes the reservoir piece 30 to move downwardly, with the guide wall 24 sliding through the slit 68 and the tabs 62 travelling along the slots 52, which in turn causes the opening 60 to align with the opening 36. See FIG. 6. In this manner, the interaction between the curved guide wall 24 and the curved slit 68, and the tabs 62 travelling in the slots 52, function as a type of track along which the reservoir piece 30 can experience reciprocal movement. This alignment allows the contents (e.g., a rounded candy piece) to roll through the openings 60, 36 and to the U-shaped collection area 40 (see FIG. 4) at the front facing side of the platform 28, where the user can retrieve the item. When the user's grip is released on the housings 12 and 14, the spring 70 will naturally bias the reservoir piece 30, causing the opening 60 to again be mis-aligned with the opening 36. During the dispensing operation, the guide wall 24 is positioned entirely inside the cylindrical storage section 54 opposite the opening 60 and functions to guide the candy towards the opening 60. However, the curved guide wall 24 is not positioned in the cylindrical storage section 54 when the candy dispenser 10 is in the non-dispensing position.

The candy dispenser 10 can be provided in any size but preferred size is one where the user can hold it in his or her hand, since the user will need to grip it in one hand to dispense a piece of candy. This size will also allow the candy dispenser 10 to easily fit inside a pocket.

Thus, the present invention provides a candy dispenser 10 that can be sized and shaped to fit inside a pocket. The candy dispenser 10 can be easily operated for use to automatically dispense the candy contained therein by simply squeezing or gripping the candy dispenser 10.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A dispensing apparatus, comprising:

a lower housing having an outer surface and a recessed wall positioned inside the lower housing, the recessed wall having a recessed opening that is recessed from the outer surface of the lower housing;

a reservoir piece seated inside the lower housing and having a containing section that holds at least one item to be dispensed, the containing section having an enclosing wall, a base and reservoir opening provided in the enclosing wall that communicates with the interior of the containing section; and a biasing element positioned between the base of the reservoir piece and the lower housing, the biasing element having a normal bias that normally biases the reservoir piece to a non-dispensing position where the reservoir opening and recessed opening are not aligned; and an upper housing;

wherein upper housing and lower housing can be squeezed together to cause the reservoir piece to move downwardly against the normal bias of the biasing element, so as to align the reservoir opening and recessed opening to arrive at a dispensing position;

and wherein a collection area is defined between the recessed wall and the outer surface of the lower housing.

2. The apparatus of claim 1, wherein the lower housing has a support wall that has opposite ends, with a slot defined at each of the opposite ends of the support wall, and wherein the reservoir piece further includes two opposing tabs, each tab positioned in a separate slot for up-and-down movement in the corresponding slot.

3. A dispensing apparatus, comprising:

a lower housing having lower housing opening;

a reservoir piece seated inside the lower housing and having a containing section that holds at least one item to be dispensed, the containing section having an enclosing wall, a base and reservoir opening provided in the enclosing wall that communicates with the interior of the containing section; and a biasing element positioned between the base of the reservoir piece and the lower housing, the biasing element having a normal bias that normally biases the reservoir piece to a non-dispensing position where the reservoir opening and lower housing opening are not aligned; and an upper housing;

wherein upper housing and lower housing can be squeezed together to cause the reservoir piece to move downwardly against the normal bias of the biasing element, so as to align the reservoir opening and lower housing opening to arrive at a dispensing position;

further including a platform having a top wall and a rear wall that extends below the top wall from a rear edge of the top wall, the rear wall having platform opening that is always aligned with the lower housing opening, and which is aligned with the reservoir opening in the dispensing position but mis-aligned with the reservoir opening in the non-dispensing position.

4. The apparatus of claim 3, wherein the lower housing has a support wall that has opposite ends, and wherein the platform further includes two rearwardly-extending curved wings, each seated on one of the opposite ends of the support wall.

5. The apparatus of claim 3, wherein the lower housing has a support wall that has opposite ends, with a slot defined at each of the opposite ends of the support wall, and wherein the reservoir piece further includes two opposing tabs, each tab positioned in a separate slot for up-and-down movement in the corresponding slot.

6. A dispensing apparatus, comprising:

a lower housing having lower housing opening;

a reservoir piece seated inside the lower housing and having a containing section that holds at least one item to be dispensed, the containing section having an enclosing wall, a base and reservoir opening provided in the enclosing wall that communicates with the interior of the containing section; and a biasing element positioned between the base of the reservoir piece and the lower housing, the biasing element having a normal bias that normally biases the reservoir piece to a non-dispensing position where the reservoir opening and lower housing opening are not aligned; and an upper housing;

wherein upper housing and lower housing can be squeezed together to cause the reservoir piece to move downwardly against the normal bias of the biasing element, so as to align the reservoir opening and lower housing opening to arrive at a dispensing position;

wherein the lower housing has a curved guide wall that is positioned opposite the lower housing opening, with the curved guide wall positioned in the containing section of the reservoir piece when the reservoir piece is in the dispensing position, and not positioned in the containing section of the reservoir piece when the reservoir piece is in the non-dispensing position.

7. The apparatus of claim 6, wherein the lower housing has a support wall that has opposite ends, with a slot defined at each of the opposite ends of the support wall, and wherein the reservoir piece further includes two opposing tabs, each tab positioned in a separate slot for up-and-down movement in the corresponding slot.

* * * * *